US008925218B2

(12) United States Patent
Anderson

(10) Patent No.: US 8,925,218 B2
(45) Date of Patent: Jan. 6, 2015

(54) HIGH-HEELED SHOE WITH EXCHANGEABLE HIGH-HEELS

(71) Applicant: Juanita Anderson, Greenwood, IN (US)

(72) Inventor: Juanita Anderson, Greenwood, IN (US)

( * ) Notice: Subject to any disclaimer, the term of this patent is extended or adjusted under 35 U.S.C. 154(b) by 260 days.

(21) Appl. No.: 13/647,980

(22) Filed: Oct. 9, 2012

(65) Prior Publication Data

US 2014/0096413 A1 Apr. 10, 2014

(51) Int. Cl.
*A43B 21/37* (2006.01)

(52) U.S. Cl.
USPC ..... 36/42; 36/100

(58) Field of Classification Search
CPC ..... A43B 21/37; A43B 21/42; A43B 21/48; A43B 21/38; A43B 21/39; A43B 21/47; A43B 3/244
USPC ..... 36/42, 100, 36 R, 36 A, 36 B, 36 C
See application file for complete search history.

(56) References Cited

U.S. PATENT DOCUMENTS 1,829,252 A * 10/1931 Zubia et al. ..... 36/42
1,829,253 A * 10/1931 Zubia et al. ..... 36/42
3,266,177 A 8/1966 Holden
3,514,879 A 6/1970 Frattallone
4,198,770 A * 4/1980 Orea Mateo ..... 36/42
4,805,320 A 2/1989 Goldenberg et al.
5,309,651 A 5/1994 Handel
5,347,730 A 9/1994 Colon
5,456,026 A 10/1995 Lewis
5,524,365 A 6/1996 Goldenberg
7,185,448 B2 3/2007 Schupbach
7,578,075 B1 8/2009 Kemp
7,975,405 B1 * 7/2011 Kemp ..... 36/100
2012/0055048 A1 * 3/2012 Haupt et al. ..... 36/34 R
2013/0019498 A1 * 1/2013 Causey et al. ..... 36/42

* cited by examiner

*Primary Examiner* — Ted Kavanaugh
(74) *Attorney, Agent, or Firm* — John M. Bradshaw; Overhauser Law Offices LLC

(57) ABSTRACT

A high-heeled shoe is configured to utilize exchangeable high-heels. A biased, pivoting latch is formed into the sole of the shoe at the heel portion of the sole. A heel stem or support is fixedly attached to the shoe and extends from the sole and about the pivoting latch, terminating in a tip. The stem has a length at least approximately equal to a desired length of the high-heel. An exchangeable high-heel is characterized by a generally hollow body having a resilient stem holder therein configured to releasably receive and hold the heel stem. A reinforcement is provided at a rear of the exchangeable high-heel that extends from a top to approximately a bottom of the exchangeable high-heel and carries a catch proximate the top thereof. The latch includes a flange that engages the catch while the latch is normally biased.

19 Claims, 7 Drawing Sheets

HIGH-HEELED SHOE WITH EXCHANGEABLE HIGH-HEELS

FIELD OF THE INVENTION

The present invention relates to the field of shoes and, more particularly, to shoes having replaceable and/or exchangeable heels.

BACKGROUND

It has been recognized that a shoe with an interchangeable or exchangeable heel can offer versatility while providing several advantages over having multiple pairs of shoes. Such advantages include reducing the number of shoes one has, reducing money spent on shoes, and being able to use one pair of shoes with many outfits and/or for many situations. A shoe that can offer different looks and/or styles through an interchangeable or exchangeable heel would thus be a welcome addition to most shoe collections.

As such, various shoes have been developed that are configured to allow a heel to be releasably attached to a shoe body. This permits a wearer to exchange one heel for another. In order to accomplish this feat, the shoe body and heel must incorporate a manner of attaching and detaching a heel to the shoe body. This is achieved by a providing a releasable attachment structure incorporated into the shoe body and heel.

For instance, U.S. Pat. No. 7,185,448 B2 issued Mar. 6, 2007 to Schupbach, discloses a shoe with interchangeable heels. A sole of a shoe body has a sleeve and groove for receiving an elongated blade of an interchangeable heel. A latch is provided in the front of a heel portion of the interchangeable heel for connecting the heel portion to a stub that projects from the heel area of the sole. The latch provides releaseable connection of the heel portion to a front portion of the stub. However, since the latch is only holding a heel portion hanging from the elongated blade, it is not very robust. Moreover, the connection of the heel portion from the front of the heel does not positively hold the heel portion to the sole, especially the rear of the heel portion.

U.S. Pat. No. 5,456,026 issued Oct. 10, 1995 to Lewis, shows a shoe with exchangeable heels. A latch is mounted to sole proximate the heel area of the shoe body, while a top surface of a heel has a configured recess thereof. The latch includes a wedge portion and a leaf-spring attached to the wedge portion. The leaf-spring has a stepped detent and a lever biased by spring tension away from the wedge portion. The configured recess of the heel receives the wedge of the latch in a dove-tail connection, while an internal cavity of configured recess for housing the leaf-spring of the latch. Because the latch is carrying the entire load of the connection of the heel to the shoe body, the spring tension of the latch must be quite large. This makes the latch difficult to operate especially if the user cannot easily apply the force necessary to overcome the spring tension.

In U.S. Pat. No. 7,578,075 issued Aug. 25, 2009 to Kemp, a shoe is disclosed having, among other features, a removable heel. The sole of the shoe body has a configured cutout which receives a complimentarily-shaped end structure of a heel. A spring latch is disposed in the sole at a front (i.e. towards a toe portion of the shoe) of an attached heel for releasably engaging a front portion of a heel. While the latch is incorporated into the sole of the shoe body and is easy to operate, the connection of the heel portion from the front of the heel does not positively hold the heel portion to the sole, especially the rear of the heel portion. This is why the shoe body incorporates the configured cutout that receives the complimentarily-shaped end structure of the heel.

U.S. Pat. No. 4,805,320 issued Feb. 21, 1989 and U.S. Pat. No. 5,524,365 issued Jun. 11, 1996 to Goldenberg et al., show a shoe with a removable and replaceable heel. A short shaft is attached to the sole surface of the shoe body that is adapted to fit into a short bore in a heel. A latch is provided between the short shaft and the heel for releasable attachment of the heel to the shoe body. However, since the latch is the connection between the heel and the shoe body, the spring tension of the latch must be quite large. This makes the latch difficult to operate especially if the user cannot easily apply the force necessary to overcome the spring tension.

It is apparent from the above that there exists a need for a shoe having an exchangeable, interchangeable or replaceable heel, particularly a high-heeled shoe, having a robust but easily operable manner of connecting and detaching a heel to a shoe body.

The problems in the prior art addressed above, the desirables presented herein, and more are addressed by the present invention.

SUMMARY OF THE INVENTION

The present invention is a high-heeled shoe having exchangeable, interchangeable, and/or replaceable (collectively, and hereinafter, exchangeable) high-heels. The present high-heeled shoe is characterized by a shoe body, an elongated high-heel support attached to and extending from a sole of the shoe body and having a length approximately equal to a desired height of the high-heel, a normally biased latch incorporated into the sole of the shoe body and situated about the elongated high-heel support, and a high-heel configured for releasable engagement with the elongated high-heel support and the normally biased latch.

The normally biased latch is characterized by a plate that is pivotally connected with or to the sole of the shoe body so as to define a first plate portion on a first side of the pivot, and a second plate portion on a second side of the pivot. The latch includes a spring element that controls pivoting or toggling of the latch plate (i.e. the first and second plate portions about the pivot) by applying a constant (i.e. normal) biasing force against the first plate portion. This controls the position of the second plate portion as well as providing a biasing force against the second plate portion. A flange or arm extends from an end of the second plate portion that is configured to receive a catch of the high-heel during normal biasing. The latch is released by applying manual pressure against the first plate portion, thereby releasing tension against the second plate to disengage the flange thereof from the catch of the high-heel.

The elongated high-heeled support preferably, but not necessarily, includes a tip at its end distal the shoe body. The tip provides support for elongated high-heeled support.

The high-heel is characterized by a body or shell taking on any shape of high-heel as desired. The high-heel body encloses one or more resilient brackets or holders configured to releasably retain the elongated high-heel support, and the latch catch. The latch catch extends from a brace that is situated along the rear of the high-heel body and is configured to releasably receive the flange of the second plate portion when the high-heel is connected to the shoe body.

The present invention provides various advantages over prior art exchangeable-heeled, and particularly, exchangeable high-heeled shoes. Particularly, by incorporating an elongated high-heel support having a height approximately equal to the desired height of the high-heeled shoe, the elongated high-heeled support provides weight support for the shoe rather than the exchangeable high-heel. Also, by incorporating the latch into the sole of the high-heeled shoe and having a portion thereof situated about the elongated high-heel support, the high-heel is more solidly attached to the shoe. Moreover, by incorporating resilient brackets for retaining the elongated high-heel support along the length of the high-heel body, the high-heel is more securely attached to the shoe.

BRIEF DESCRIPTION OF THE DRAWINGS

The above mentioned and other features, advantages and object of this invention, and the manner of attaining them, will become apparent and the invention itself will be better understood by reference to the following description of an embodiment of the invention taken in conjunction with the accompanying drawings, wherein.

Like reference numerals indicate the same or similar parts throughout the several figures.

A description of the features, functions and/or configuration of the components depicted in the various figures will now be presented. It should be appreciated that not all of the features of the components of the figures are necessarily described. Some of these non discussed features as well as discussed features are inherent from the figures. Other non discussed features may be inherent in component geometry and/or configuration.

DETAILED DESCRIPTION

Figure 1:
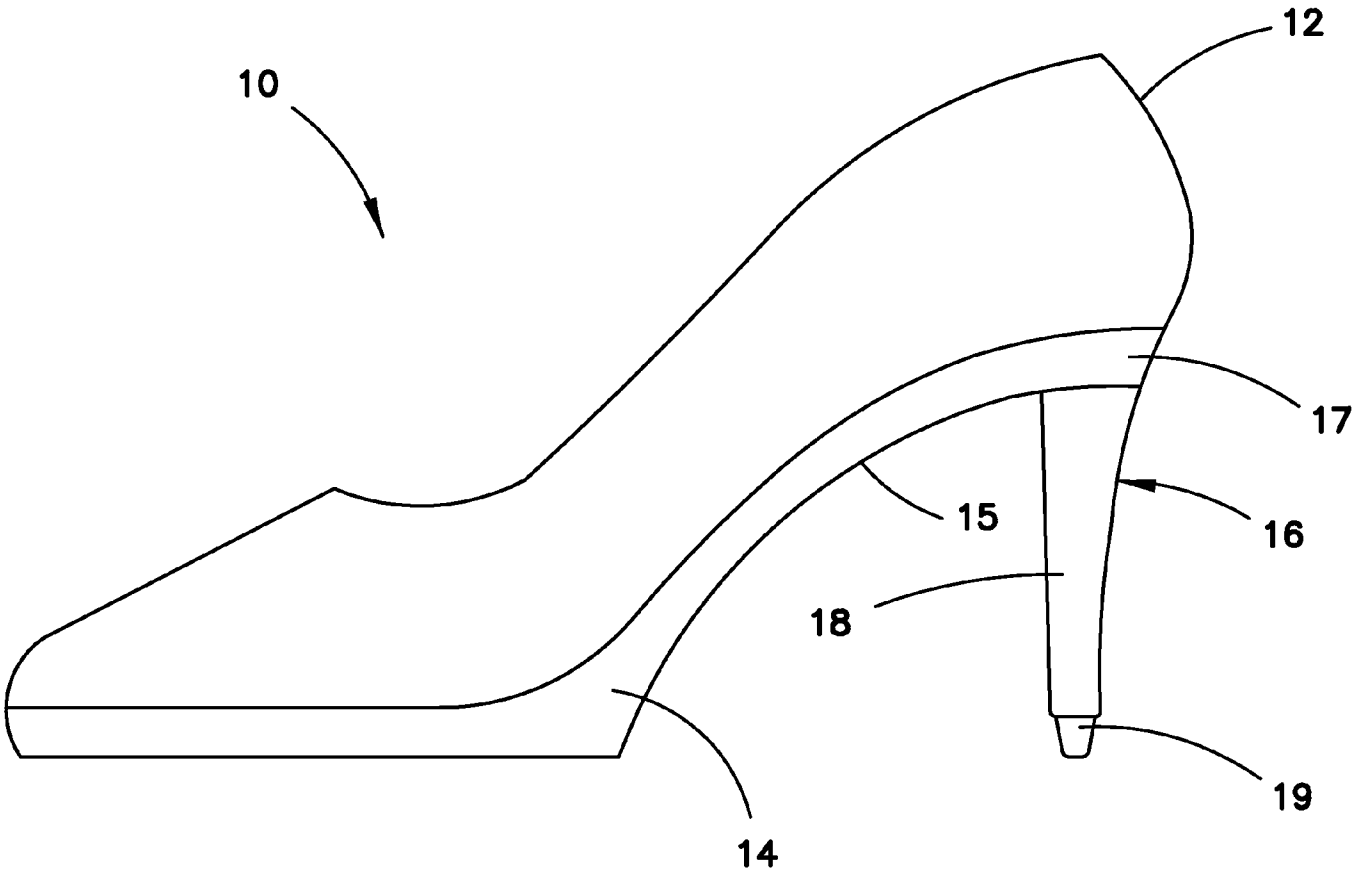
FIG. 1 is a side plan view of a high-heeled shoe having an exchangeable high heel in accordance with the principles of the present invention.

Referring to FIG. 1, there is illustrated a high-heeled shoe 10 having an exchangeable, replaceable, and/or interchangeable (collectively, and hereinafter, exchangeable) high-heel 16 in accordance with the present principles. The high-heeled shoe 10 is characterized by an upper 12 shaped like a typical upper of a high-heeled shoe with a sole 14, again shaped like a typical sole of a high-heeled shoe. While only one design or shape of a high-heel shoe is shown, it should be appreciated that the principles of the present invention are applicable to high-heeled shoes of different designs and/or shapes. It should also be appreciated that while only one design or shape of an exchangeable high-heel 16 is shown, other designs or shapes of exchangeable high-heels are contemplated and may be used as long as they incorporate the features shown and/or described herein.

The sole 14 defines a bottom, lower or undersurface 15 and a rear portion 17 from which an exchangeable high-heel 16 is releasably attached. As seen in FIG. 1, the exchangeable high-heel 16 is defined by an essentially hollow body 18. The hollow body 18 is made from any material desired since, as explained in greater detail below, the body 18 does not bear weight and/or provide structural support for the shoe. Therefore, the body 18 may be made of glass, plastic, wood, leather, metal, rubber, stone and/or any other material as desired.

Figure 2:
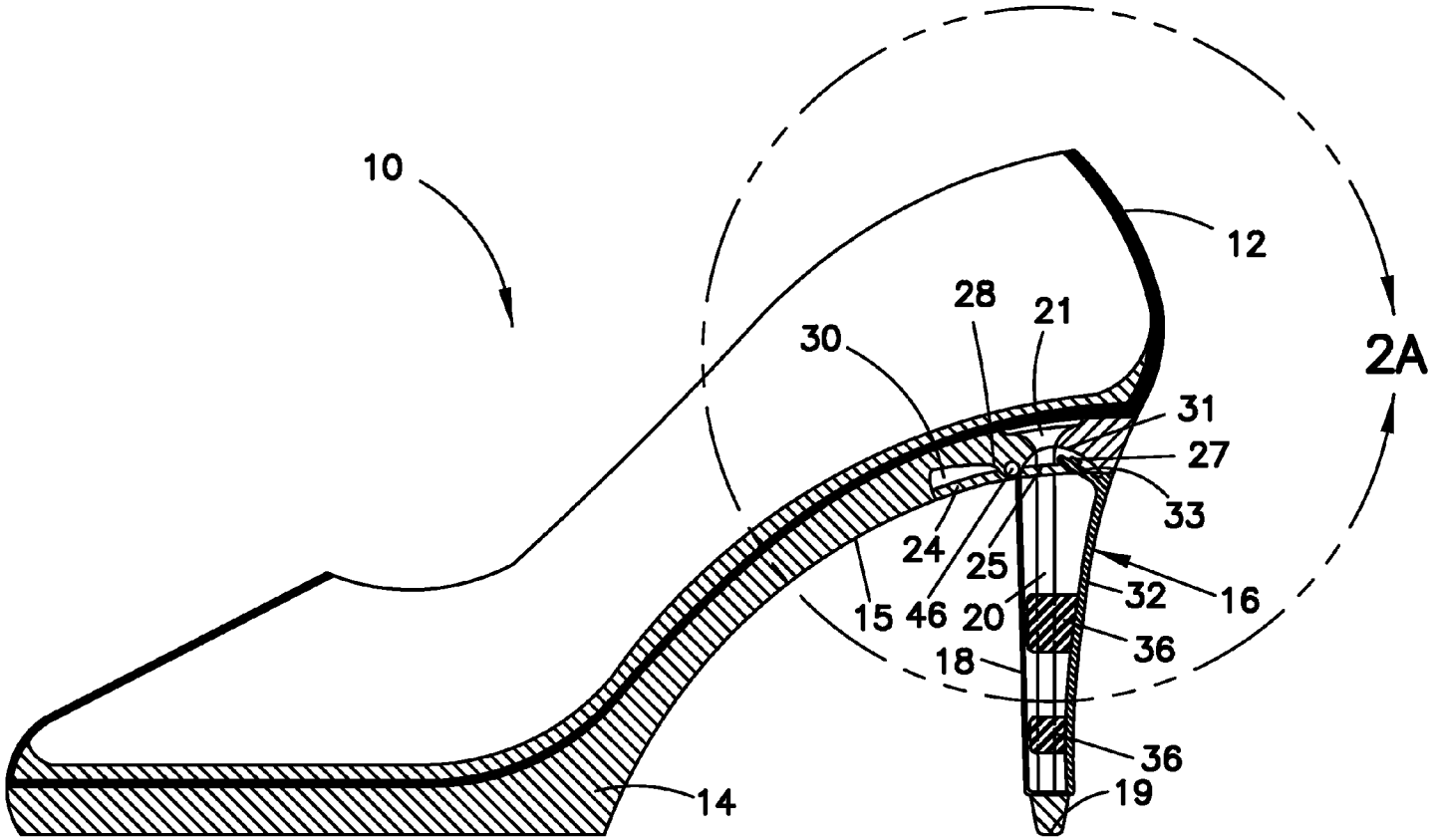
FIG. 2 is a side sectional view of the high-heeled shoe of FIG. 1.
Figure 2A:
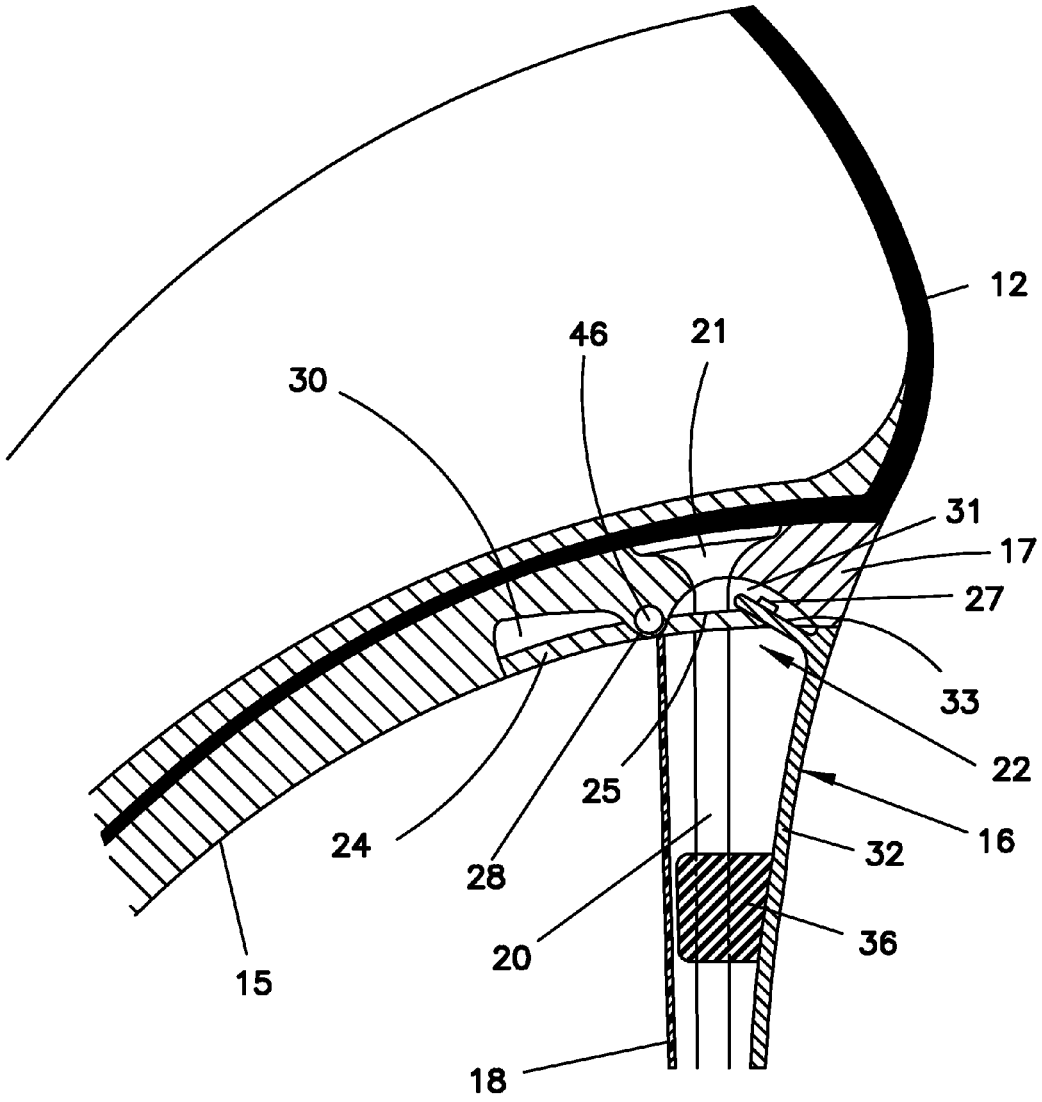
FIG. 2A is an enlarged sectional view of the rear portion of the high-heeled show of FIG. 2 taken along circle 2A thereof.
Figure 3:
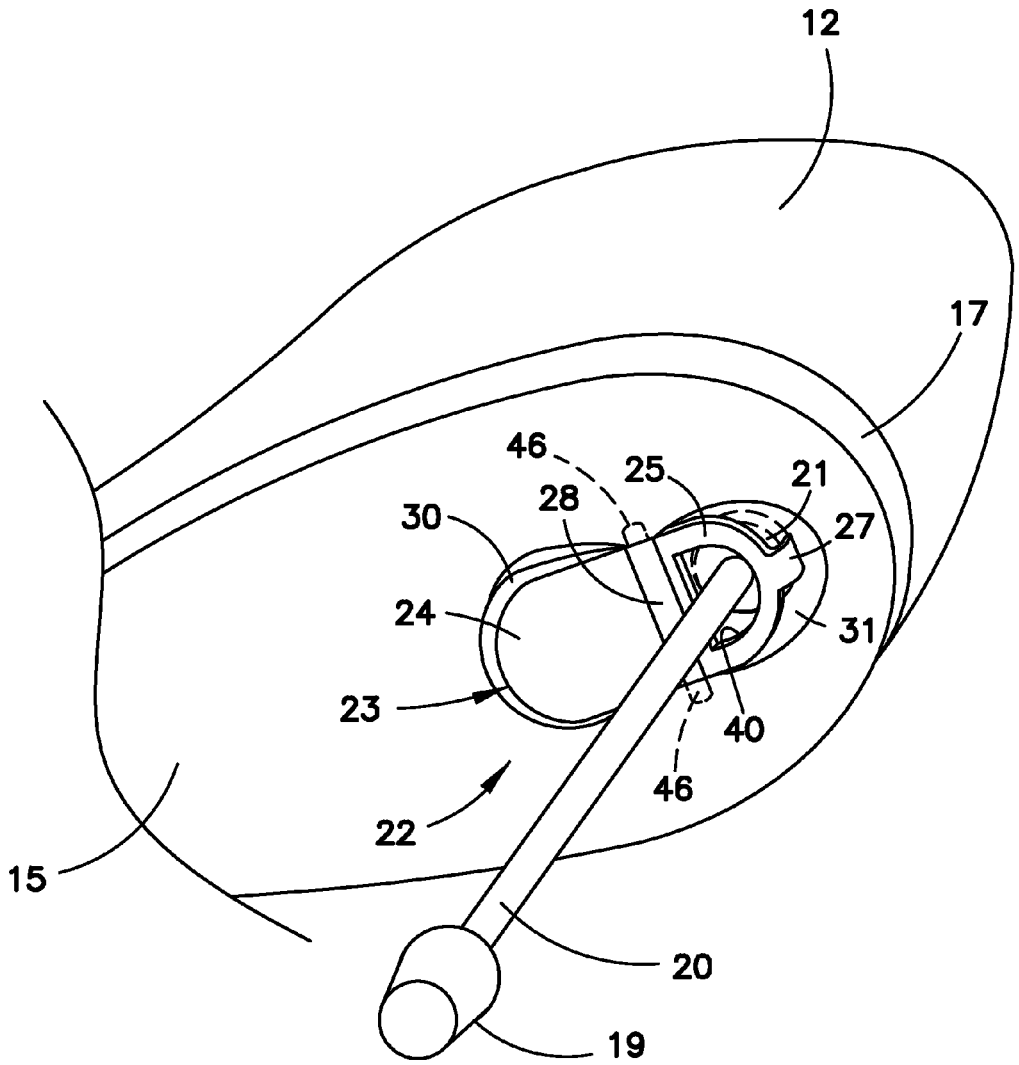
FIG. 3 is a bottom side view of the rear portion of the high-heeled shoe of FIG. 1 with the exchangeable high heel removed to show the pivoting attachment and release mechanism for the exchangeable high heel and the permanent high heel substructure/foundation thereof.

Referring additionally to FIGS. 2, 2A and 3, the high-heeled shoe 10 of FIG. 1 is shown in sectional particularly to illustrate and describe the components and/or features of the present high-heeled shoe 10 and the manner in which an exchangeable high-heel 16 is releasably coupled or attached to the sole 14. An elongated high-heel rod, stem or support 20 extends from a base 21 that is imbedded in or otherwise attached to the sole 14 or fixedly mounted to the shoe 10. A tip 19 is preferably, but not necessarily, provided at the end of the elongated support 20. The tip 19, when part of the exchangeable high-heel 16, is made from a material that is able to support weight such as rubber, plastic, wood, or the like. If a tip is not used, the bottom of the body 18 is made from a material that is able to support or bear weight such as rubber, wood, plastic or the like. As best seen in FIG. 3, the high-heel support 20 is centrally positioned at the rear 17 of the heel portion of the shoe and extends a length equal or at least approximately equal to a desired height of the high-heeled shoe, excepting the tip 19 if used. The high-heel support 20 is made from a material that is able to support weight such as wood, plastic, metal or the like. The high-heel support 20 is rigidly held by the shoe and of sufficient size so as to bear weight under standing and/or walking conditions.

The sole 14 carries a latch or similar mechanism 22 that is configured to releasably retain the high-heel 16 onto the bottom 15 of the rear 17 of the sole 14 of the shoe and about the high-heel support 20. The latch 22 is formed in part by a configured plate or other structure 23 that is pivotally attached to the sole 14. One manner of pivotally retaining the plate 23 onto the bottom 15 of the sole 14 includes a boss 28 through which is disposed a pin 46 that is held by and in the sole 14. As additionally seen in FIG. 5 (being a downward view of the latch 22 and exchangeable high-heel 16 as seen from the top thereof with the sole 14 removed for clarity) and FIG. 6 (being an upper side view of the latch 22 and the exchangeable high-heel 16 with the sole 14 removed for clarity), the plate 23 includes a first plate boss 47 and a second plate boss 48 through which the pivot pin 46 extends such that the plate 23 is pivotally retained on the sole 14. It should be appreciated that here and throughout, the nomenclature first and second is arbitrary.

The bottom 15 of the sole 14 has a first recess, cavity, depression, cutout or the like 30 on one side of the sole boss 28 that is proximate the toe end of the shoe 10 and a second recess, cavity, depression, cutout or the like 31 on another side of the sole boss 28 that is proximate the heel end of the shoe 10. Between the first and second plate bosses 47, 48 the plate 23 defines a first generally arced portion 24 and a second generally arced portion 25. The plate 23 is retained by the sole 14 such that the first plate portion 24 lies over the first recess 30 and, in a normally biased state of the plate 23 (e.g. as depicted in FIGS. 1 and 2), is generally flush with the bottom 15 of the sole 14, while the second plate portion 25 lies over the second recess 31 and, in a normally biased state of the plate 23 (e.g. as depicted in FIGS. 1 and 2), is likewise generally flush with the bottom 15 of the sole 14. It should be appreciated that the plate 23 and/or its parts or components may be configured in shapes other than that shown, and the associated or corresponding recesses may be shaped accordingly. For instance, the first arced portion 24 may be configured as a button rather than as a flat plate as shown. The button may be sized smaller than the first arced portion 24 and therefore require less of the associated recess 30. Particularly, the recess 30 may be sized such that only the button is visible from the sole 15 and accessible to the user. Thus, rather than a plate that the user presses to disengage the heel, the user presses a button that disengages the heel. Other configurations are contemplated.

Figure 5:
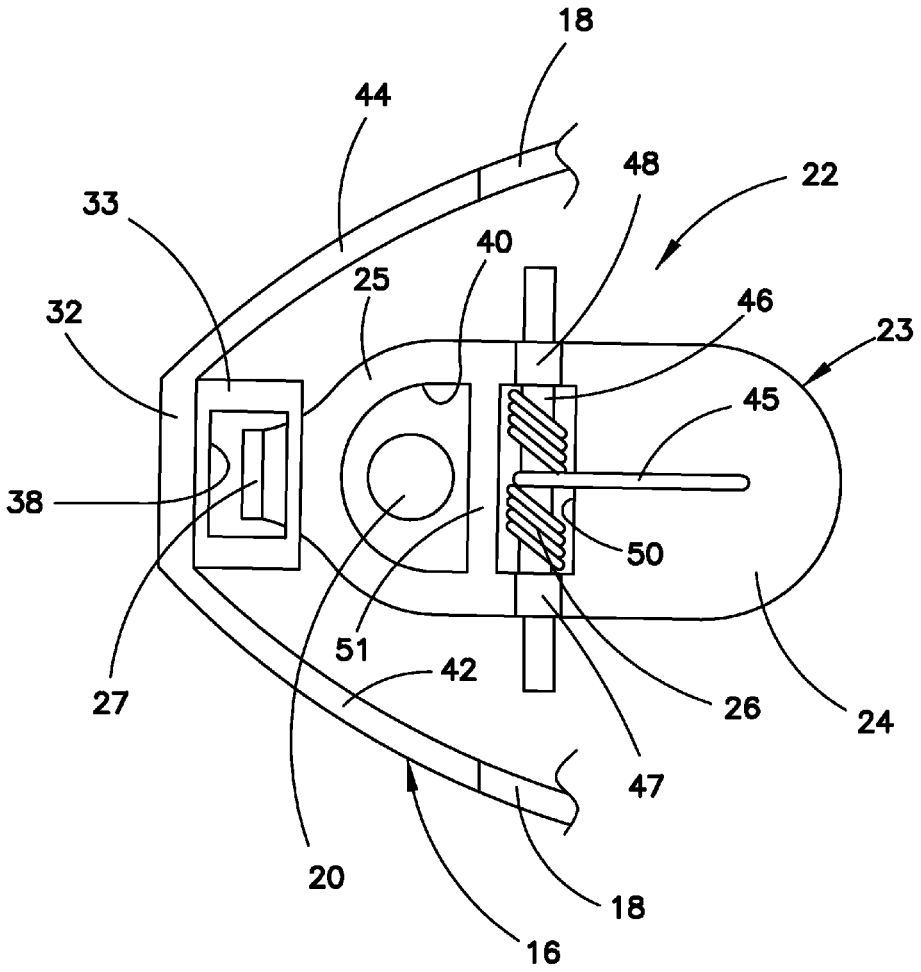
FIG. 5 is a top plan view of the pivoting attachment and release mechanism illustrating the structure of the mechanism and the manner in which a exchangeable high-heel is received by the pivoting attachment and release mechanism.
Figure 6:
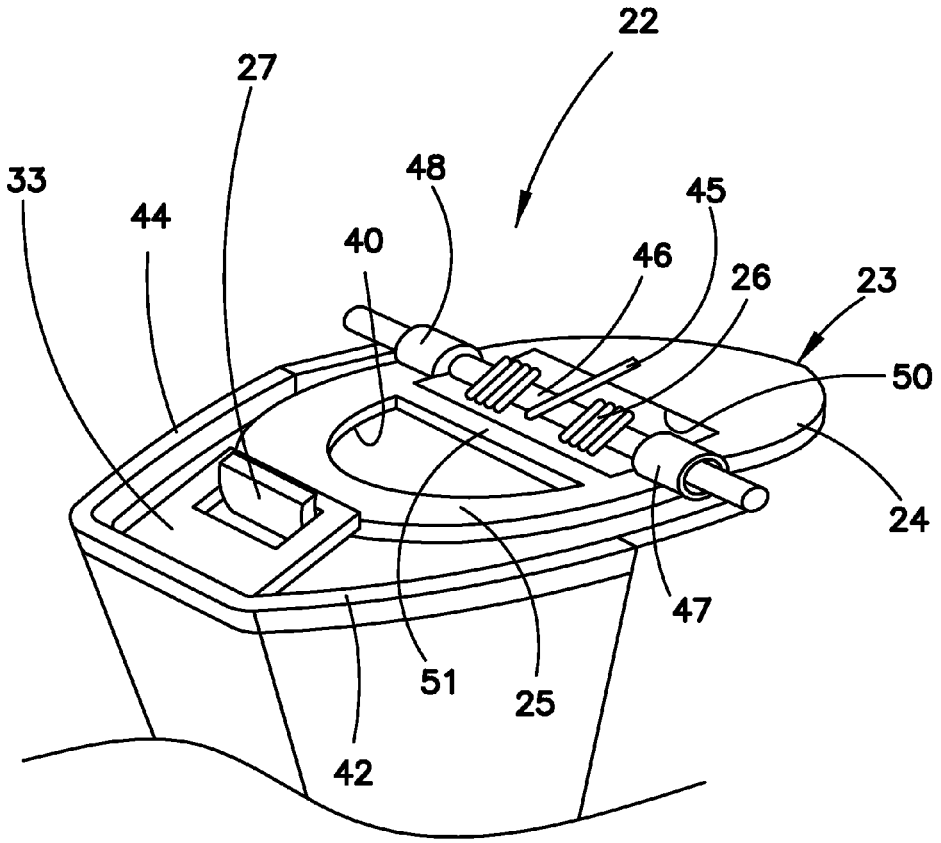
FIG. 6 is an upper side view of a portion of a exchangeable high heel and the pivoting attachment and release mechanism again illustrating the structure of the mechanism and the manner in which a exchangeable high-heel is received by the pivoting attachment and release mechanism.

Referring additionally to FIGS. 5 and 6, the first plate portion 24 has a cutout 50 in order to accommodate a spring or spring element 26 of the latch 22 that is situated about the pivot pin 46. The spring 26 includes an arm 45 that extends over and onto the first plate portion 45. The spring 26 and arm 45 provide a force against the first plate portion 24 that normally biases the first plate portion 24 downward away from the first cavity 30 and sole 14 and the second plate portion 25 upwards toward the second cavity 31 and sole 14. As explained further below, this normal biasing allows a flange 27 situated at the end of the second plate portion 25 to engage a catch 33 of the exchangeable high-heel 16 in order to aid in retaining the exchangeable high-heel 16 onto the sole 14 of the shoe 10. It should be appreciated that other manners and/or configurations of springs or spring elements may be used to provide the required spring action.

The second plate portion 25 also includes a cutout 40 which is separated from the cutout 50 by a connecting member 51. The pivoting plate 23 is situated on the sole 14 such that the high-heel support 20 extends through the cutout 40. This is particularly shown in FIG. 3 where the shoe 10 is illustrated without an exchangeable high-heel thereon. Because of the cutout 40, the plate 23 pivots without interference from the high-heel support 20. Again, the configuration of the second plate portion 25 may be modified as appropriate as well as the associated of corresponding recess.

The flange 27 extends upwardly from an end of the second plate portion 25 and, in the normally biased state of the plate 23, is urged upwardly towards the cutout 31. When an exchangeable high-heel 16 is situated onto the shoe 10, the flange 27 engages the catch 33—i.e. the flange 27 is received in and by an opening 38 of the catch 33. Manually pushing the first plate portion 24 into the cutout 30 overcomes the normal biasing of the spring 46 causing the plate 23 to pivot about the pivot pin 46 and moving the second plate portion 25 and thus the flange 27 out of engagement with the catch 33. This allows the removal of the high-heel 16 from the catch 33.

Figure 4:
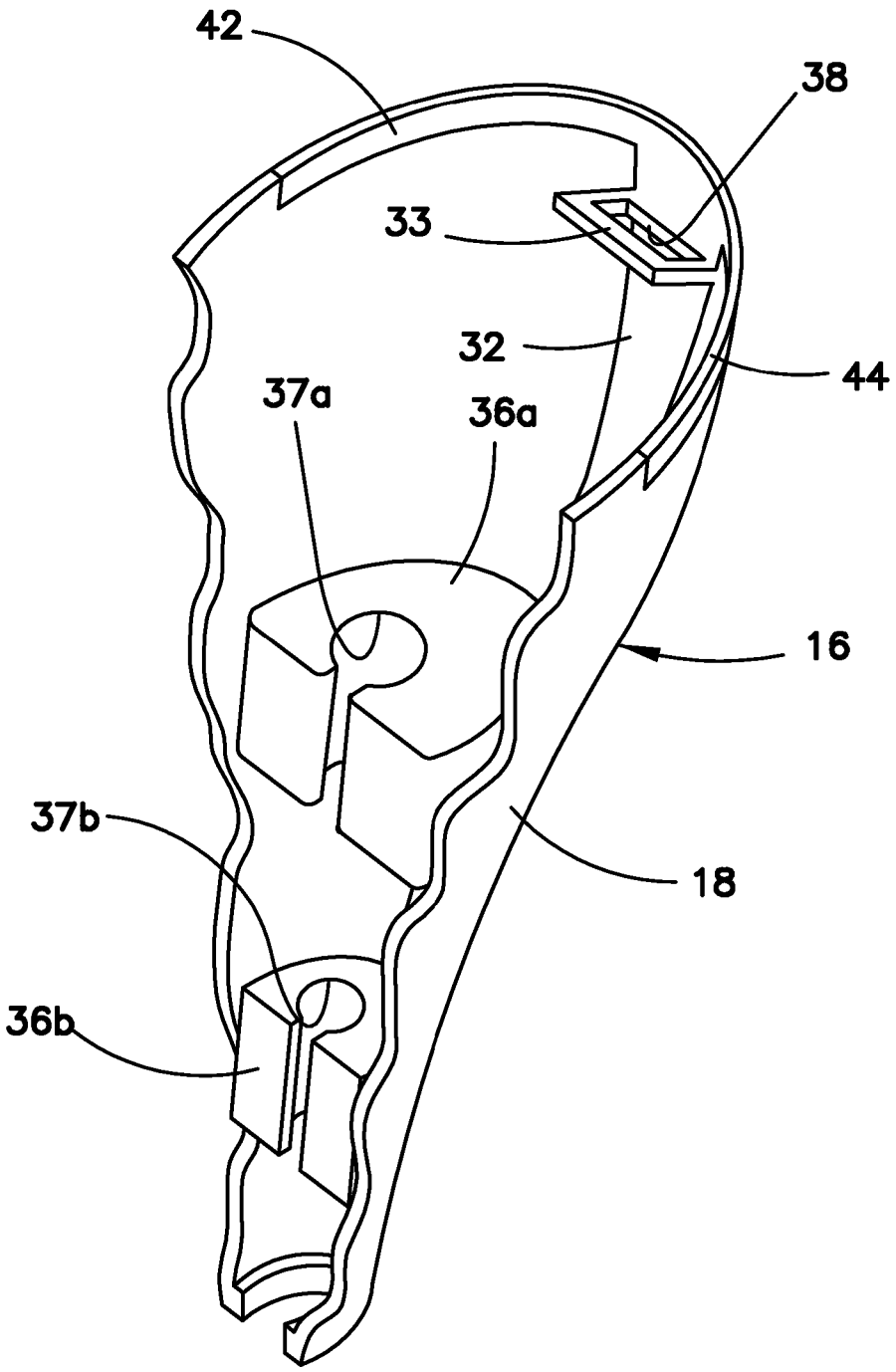
FIG. 4 is an enlarged, cutaway perspective view of a exchangeable high-heel for the present exchangeable high-heel shoe.

Referring to FIG. 4, there is shown the exchangeable high-heel 16 in cutaway view in order to illustrate the features and/or components thereof. The body 18 is essentially a generally hollow shell or frame that is configured to be fitted or provided over the elongated support 20 and held onto the shoe body 12, 14 by the latch 22. The body 18 houses first and second holders 36*a*, 36*b* that are preferably, but not necessarily, formed of rubber or other resilient material. The first and second holders 36*a*, 36*b* each have a cavity 37*a*, 37*b* that is configured to allow the high-heel support 20 to be press fit into the respective cavity 37*a*, 37*b* and to releasably hold the high-heel support 20. As such, each cavity 37*a*, 37*b* has a generally circular inner wall to snugly receive and hold the circular high-heel support 20. The bottom of the body 18 has a cutout shaped to fit over the end of the elongated support 20 just above the tip 19. When the high-heel 16 is installed onto the sole 14 of the shoe 10, the high-heel 16 slips onto the elongated support 20 as the catch 33 receives the flange 27. As the high-heel 16 is pivoted onto the flange 27, the elongated support 20 is received in the resilient holders 36*a*, 36*b*. When the high-heel 16 is attached, the high-heel body 18 fits over the elongated support 20 and just above the tip 19. Thus, the weight of the wearer is borne by the high-heel support 20 and tip 19, and not the high-heel 16.

The body 18 also includes a longitudinal strip or band 32 that preferably, but not necessarily, extends along the rear inside surface of the body 18 from a top of the body to the tip 19 thereby forming a brace. The longitudinal strip 32 is preferably, but not necessarily, formed of metal or other rigid material and provides reinforcement of the high-heel 16 as well as a solid foundation for the catch 33. As best seen in FIG. 2A, the catch 33 extends outward and slightly upward from the longitudinal strip 32. The body 18 also includes a first reinforcing strip 42 extending from one side of the longitudinal strip 32 at and along a first upper side end of the body 18, and a second reinforcing strip 44 extending from another side of the longitudinal strip 32 at and along a second upper side end of the body 18.

An exchangeable high-heel 16 is received by the shoe in the following manner. The latch 22 is manually pivoted to allow the flange 27 to pivot downwardly. Particularly, the first plate portion 24 is pushed inwardly into the cavity 30 of the sole 14 and held, overcoming the natural bias of the spring 46. This pivots the second plate portion 25 and thus the flange 27 away from the cavity 31. While the latch 22 is still being biased by the user, the flange 27 of an exchangeable high-heel 16 is hooked into the catch 33, while the high-heel support 20 is engaged by the first and second holders 36*a*, 36*b*. The latch 22 is released by the user which pivots the latch 22 thereby pushing the first plate portion 24 downwardly away from the cavity 30 while biasing the second plate portion 25 into the cavity 31 to hold the flange 27 in the catch 33. Removal of the exchangeable high-heel 16 is accomplished by manually pivoting the plate 23 to release the flange 27 from the catch 33 while the high-heel body 18 is removed from the high-heel support 20.

Each exchangeable high-heel includes the features and/or components as shown and/or described for the exchangeable high-heel 16. It should be appreciated that the present exchangeable high-heeled shoe 10

While the invention has been illustrated and described in detail in the drawings and foregoing description, the same is to be considered as illustrative and not restrictive in character and that all changes and modifications that come within the spirit of the invention are desired to be protected.

All references cited in this specification are incorporated herein by reference to the extent that they supplement, explain, provide a background for or teach methodology or techniques employed herein.

What is claimed is:

1. A high-heeled shoe defining a high-heel height, the shoe comprising:

a shoe body having an upper and a sole attached to the upper, the sole defining a lower surface;

an elongated support fixedly attached to the shoe body and extending from the lower surface of the sole within a heel area of the shoe body, the elongated support having a length approximately equal to the high-heel height;

a latch pivotally situated in the lower surface of the sole and normally biased by a spring element into an engagement position; and a high-heel configured for releasable engagement with the elongated support and the latch when the latch is in the engagement ent position such that the high-heel is attached to the shoe body;

wherein the high-heel comprises:

a hollow body;

a resilient bracket disposed within the hollow body and configured for releasable reception of the elongated support; and a catch disposed within the hollow body at a rear end thereof and configured to releasably receive a flange of the latch when the latch is in the engagement position.

2. The high-heeled shoe of claim 1, wherein the latch extends about the elongated support.

3. The high-heeled shoe of claim 1, wherein the high-heel further includes a brace extending along the rear end of the hollow body.

4. The high-heeled shoe of claim 3, wherein the brace extends along an interior of the rear end of the hollow body and from an upper end to a lower end of the hollow body.

5. The high-heeled shoe of claim 1, further comprising a second resilient bracket disposed within the hollow body and configured for releasable reception of the elongated support.

6. A high-heeled shoe defining a high-heel height, the shoe comprising:

a shoe body having an upper and a sole, the sole defining a lower surface;

an elongated rod fixedly attached to the shoe body and extending from the lower surface of the sole within a heel area of the shoe body, the elongated rod having a length equal to the high-heel height;

a latch situated on a pivot pin in the lower surface of the sole and having a first portion on a first side of the pivot pin, a second portion on a second side of the pivot pin, a flange situated on the second portion, and a spring element normally biasing the latch and the flange into an engagement position; and a high-heel configured for releasable attachment to the shoe body by engagement of the high-heel with the elongated rod and the flange of the latch when the latch is in the engagement position.

7. The high-heeled shoe of claim 6, wherein pivot pin is mounted in the lower surface of the sole.

8. The high-heeled shoe of claim 6, wherein the spring element is disposed about pivot pin.

9. The high-heeled shoe of claim 8, wherein the spring element further includes an arm extending onto and against the first portion of the latch.

10. The high-heeled shoe of claim 6, wherein the high-heel comprises:

a hollow body;

a resilient holder disposed within the hollow body and configured to releasably receive the elongated rod; and a catch disposed within the hollow body at a rear end thereof and configured to releasably hold the flange of the latch when the latch is in the engagement position.

11. The high-heeled shoe of claim 10, wherein the high-heel further includes a brace extending along the rear end of the hollow body.

12. The high-heeled shoe of claim 11, wherein the brace extends along an interior of the rear end of the hollow body and from an upper end to a lower end of the hollow body.

13. The high-heeled shoe of claim 10, further comprising a second resilient holder disposed within the hollow body and configured to releasably receive the elongated rod.

14. The high-heeled shoe of claim 10, further comprising a tip situated at an end of the elongated support distal the shoe body.

15. A high-heeled shoe comprising:

a shoe body having an upper and a sole, the sole defining a lower surface with a first recess proximate a heel area of the shoe body and a second recess adjacent the first recess;

an elongated stem extending from the lower surface of the sole within the heel area of the shoe body;

a latch pivotally situated on a pivot pin in the lower surface of the sole between the first recess and the second recess, the latch defined by a plate having a first plate portion extending over the first recess, a second plate portion extending over the second recess, a flange situated on the second plate portion, and a spring element normally biasing the plate and the flange into an engagement position; and a high-heel configured for releasable attachment to the shoe body by engagement of the high-heel with the elongated stem and the flange of the second plate portion the latch is in the engagement position.

16. The high-heeled shoe of claim 15, wherein the high-heel comprises: a hollow body;

first and second resilient holders disposed within the hollow body and configured to releasably receive the elongated stem; and a catch disposed within the hollow body at a rear end thereof and configured to releasably engage the flange of the second plate portion when the latch is in the engagement position.

17. The high-heeled shoe of claim 16, wherein the high-heel further includes a brace extending along the rear end of the hollow body.

18. The high-heeled shoe of claim 17, wherein the brace extends along an interior of the rear end of the hollow body and from an upper end to a lower end of the hollow body.

19. The high-heeled shoe of claim 16, further comprising a tip situated on an end of the elongated support distal the shoe body.

* * * * *